US006522225B2

(12) United States Patent
Liang et al.

(10) Patent No.: US 6,522,225 B2
(45) Date of Patent: Feb. 18, 2003

(54) COUPLING MECHANISMS FOR DIELECTRIC RESONATOR LOADED CAVITY FILTERS

(75) Inventors: Xiao-Pang Liang, Reno, NV (US); Michael Butler, Reno, NV (US)

(73) Assignee: Allen Telecom Inc., Beachwood, OH (US)

( * ) Notice: Subject to any disclaimer, the term of this patent is extended or adjusted under 35 U.S.C. 154(b) by 0 days.

(21) Appl. No.: 10/079,675

(22) Filed: Feb. 19, 2002

(65) Prior Publication Data

US 2002/0084874 A1 Jul. 4, 2002

Related U.S. Application Data

(62) Division of application No. 09/563,883, filed on May 3, 2000, now Pat. No. 6,353,373.

(51) Int. Cl.[7] ..... H01P 1/20

(52) U.S. Cl. ..... 333/202; 333/219.1; 333/212

(58) Field of Search ..... 333/202, 212, 333/219.1, 230

(56) References Cited

U.S. PATENT DOCUMENTS 5,805,033 A * 9/1998 Liang et al. ..... 333/202

* cited by examiner

*Primary Examiner*—Robert Pascal
*Assistant Examiner*—Stephen E. Jones
(74) *Attorney, Agent, or Firm*—Michael Best & Friedrich, LLC

(57) ABSTRACT

A dielectric loaded cavity filter having a housing and a cover and defining at least two adjacent cavities having respective dielectric resonators mounted therein and separated by a transverse partition defining a coupling window in the housing. In one form, the coupling window has two spaced opposing sidewalls confronting each other, and vertically offset shoulders intermediate their length. A conductive coupling strip is secured to the shoulder of one sidewall and extends across the coupling window and over the shoulder of the other sidewall. A tuning screw is secured by threading to the housing and has an outer free end accessible from the exterior of the filter, and an internal end disposed adjacent the coupling strip, whereby when the tuning screw is rotated, the internal end of the screw moves toward and away from the coupling strip in a direction perpendicular to the cover for tuning without requiring access to the coupling strip. In another form, no coupling strip is present and the tuning screw inner end confronts a shoulder of a sidewall.

20 Claims, 2 Drawing Sheets

COUPLING MECHANISMS FOR DIELECTRIC RESONATOR LOADED CAVITY FILTERS

This application is a divisional of application(s) application Ser. No. 09/563,883 filed on May 3, 2000 now U.S. Pat. No. 6,353,373.

FIELD OF THE INVENTION

This invention relates to improved coupling mechanisms for dielectric resonator loaded cavity filters.

BACKGROUND OF THE INVENTION

It is well-known that $TE_{01}$ resonant modes may be coupled to one another simply by placing two dielectric resonators in the same cavity. The closer the dielectric resonators are to one another, the stronger the coupling.

In order to control coupling between such adjacent resonators, an iris or window may be positioned between the two dielectric resonators. The degree of coupling may be adjusted by changing the dimensions of the window or iris.

To adjust the coupling between resonators using a window or iris, typically in the past the filter had to be disassembled so that the window or iris size could be changed. That requirement was eventually dispensed with, and a variety of mechanisms for tuning dielectric resonator loaded cavity filters were developed having coupling mechanisms that were easily tunable without the need for filter disassembly. These include the tuning mechanisms shown in U.S. Pat. No. 5,805,033. For example, in FIG. 1 of U.S. Pat. No. 5,805,033, tunability was provided by using a coupling screw extending from the side of the filter which was parallel to the electric fields of the resonators. Adjustment of the screw provided tunability but, of course, required side access for tuning which was sometimes virtually impossible to provide. In the embodiment of FIGS. 6 and 7, another tuning mechanism is shown. Although it is effective and advantageous, it does depend upon the experience and expertise of the tuner at the time of assembly.

SUMMARY OF THE INVENTION

In accordance with the present invention and in one form of the invention, an improved dielectric resonator loaded cavity filter assembly comprises a housing and a cover defining an interior surrounded by an exterior. The housing interior defines at least two adjacent cavities having respective dielectric resonators mounted therein. The adjacent cavities are separated by a transverse partition defining an iris or coupling window therein, the coupling window having two spaced opposing sidewalls confronting each other, each of the sidewalls defining an inwardly extending shoulder portion intermediate its length. A conducting coupling strip is removably secured and grounded to the shoulder portion of one sidewall, as by a fastening screw. The strip extends across the coupling window, substantially parallel to the cavity bottoms, and toward and over the shoulder portion of the other sidewall. The coupling strip is positioned above and over the shoulder portion of the second sidewall and defines a gap between the strip and the shoulder portion. The filter further comprises a tuning screw secured by threading to the housing, the tuning screw having an outer free end accessible from the exterior of the housing and cover, and an internal end disposed adjacent the coupling strip, whereby when the tuning screw is rotated relative to the housing, the internal end of the screw moves toward and away from the coupling strip in a direction perpendicular to the cover for tuning without requiring access to the coupling strip. Desirably, the sidewall shoulders are vertically offset from each other and the coupling strip is spaced away from the shoulder of the other sidewall. In a most preferred form, the coupling strip lies in a flat plane throughout its length. In a preferred form, the resonators are mounted to the cover and the tuning screw is secured to the base of the housing.

A further improved dielectric loaded cavity filter in accordance with this invention comprises a housing and a cover defining an exterior and an interior, the housing interior defining at least two adjacent cavities having respective dielectric resonators mounted therein, with the adjacent cavities being separated by a transverse partition defining a coupling window in the housing. The coupling window has two spaced opposing sidewalls confronting each other, one of the sidewalls defining an inwardly extending shoulder portion below which a relatively narrow window portion is provided and above which a relatively wide window portion is provided, the ratio of the relatively wide window portion to the relatively narrow window portion being at least 2.0 to 1. A tuning screw is secured by threading to the housing, the tuning screw having a tool engaging outer end accessible from the exterior of the housing and cover, and an internal portion and internal end extending parallel to the coupling window and being generally coplanar therewith, the coupling screw overlying the shoulder and lying closely adjacent to the edge, whereby when the tuning screw is rotated relative to the housing, the internal end of the screw moves toward or away from the shoulder in a direction perpendicular to the cover.

Further objects, features, and advantages of the present invention will become apparent from the following description and drawings.

DETAILED DESCRIPTION OF THE INVENTION

In accordance with the present invention, improved dielectric resonator loaded cavity filter are described that provide distinct advantages as compared to the prior art. The invention can best be understood with reference to the accompanying drawing figures.

Figure 1:
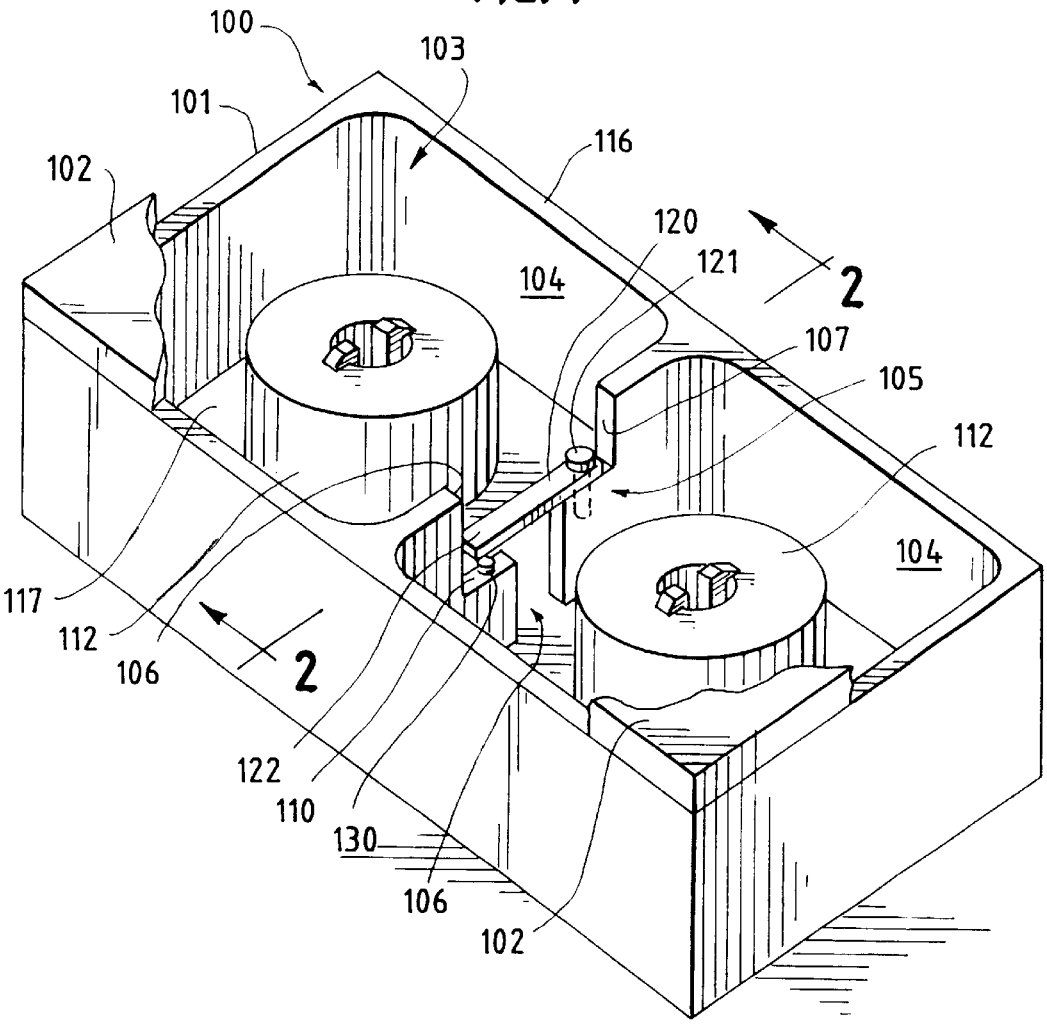
FIG. 1 is a top right perspective view of a dielectric resonator loaded cavity filter of the present invention.

Referring now to FIG. 1, a first embodiment of a dielectric resonator loaded cavity filter 100 comprises a housing 101 and a cover 102 connected thereto in a conventional manner, as by a series of screws (not shown). Housing 101 is formed of a machined or cast conductive material, such as aluminum, or may be molded from a suitable non-conductive material, such as plastic, coated internally with a conductive material in a known manner. Cover 102 may be a conductive plate.

The housing interior 103 defined by the housing and cover comprises at least two adjacent cavities 104. Cavities 104 may be formed integrally as part of the housing. Preferably, the cavities 104 are generally rectangular in cross-section, although they may be of other cross-sectional shapes such as circular or eliptical. The cavities 104 are separated by a transverse partition 105. Partition 105 may be integrally formed during the machining, casting or molding operation. The transverse partition 105 defines an iris or coupling window 106 formed therein. The coupling window 106 has first and second spaced opposing sidewalls 107, 108. Each of the sidewalls defines an inwardly extending step or shoulder portion 109 and 110, respectively. Thus, the coupling window 106 has upper and lower segments, the upper segment being wider than the lower segment.

A generally cylindrical dielectric resonator 112 is mounted to the base 113 of each cavity 104 in a predetermined, fixed spaced relationship to the coupling window and to each other in a known manner and for reasons well known in the art. In this embodiment the base comprises the cover 102. Resonators 112 may be in the shape of thick washers which are mounted to be spaced from both the cover and the bottom of the associated cavity as illustrated in U.S. Pat. No. 5,805,033.

A coupling strip 120 formed of a conductive material, such as brass, is fixed to the shoulder portion 109 of first sidewall 107, as by a screw 121. Preferably the screw is conductive. Coupling strip 120 extends across the coupling window 106. It is disposed substantially parallel to the cavity bottom and its free end 122 overlies and is spaced from the shoulder portion 110 of sidewall 108. In accordance with the present invention, coupling strip 120 defines a gap G between the strip and shoulder 110. In accordance with the preferred embodiment of the present invention, the shoulder portions 108 and 110 are vertically offset from each other and lie in spaced apart horizontal planes, each of which is substantially parallel to the bases of the cavities 104. Furthermore, the plane of strip 120 intersects the cylindrical resonators 112. For high coupling tuning efficiency, the coupling strip desirably lies in a plane which bisects the dielectric resonators 112.

Figure 2:
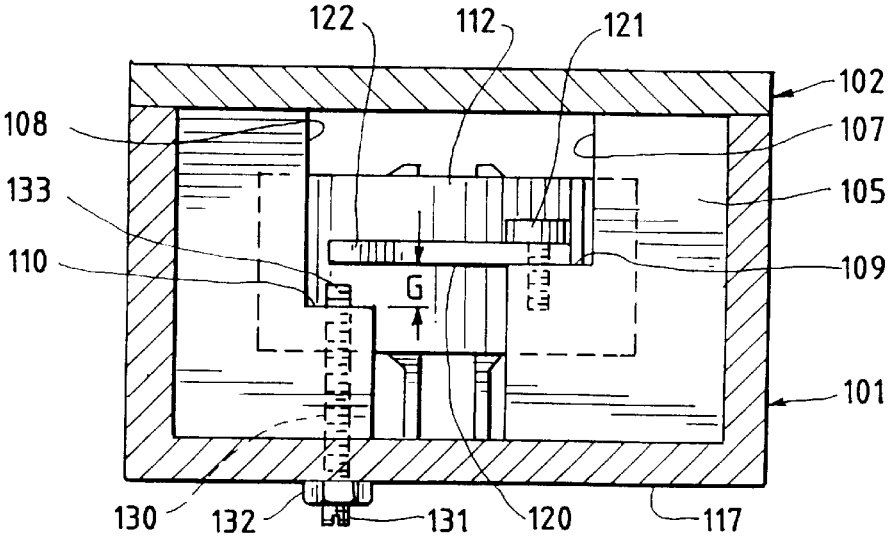
FIG. 2 is a sectional view taken substantially along section line 2—2 of FIG. 1.

Tuning screw 130, as best seen in FIG. 2, may be a threaded rod having a tool engaging outer end 131 and may be of a conductive material such as brass. It is rotatable in the housing 101 so that its inner end 133 may move generally perpendicularly relative to the free end 122 of coupling strip 120 within the gap G from its fixed position of manufacture, as illustrated by FIG. 2, to a second tuned position of the screw 130 at which the filter is optimized for its particular intended use. Coupling screw 130 may be locked in that desired tuned position by an associated lock nut 132. When tuning is to be altered, it is necessary only to release the lock nut 132, and then adjust the screw 130 via its tool engaging outer end 131 to move end 131 toward or away from the preset position relative to the free end 122 of coupling strip 120, thereby to change the capacitance and the tuning of the filter, all without requiring the opening of the housing. The adjustment may be effected simply by operating the tuning screw extending from the bottom of the housing and without requiring access to or use of the lower plate.

Although the coupling strip 120 is shown as being substantially flat, it could also be shaped so that the free end 122 is offset from the end connected to the shoulder of the opposite sidewall. Depending on that, the sidewall shoulders could be in a common plane, rather than being offset as shown and described.

In an exemplary filter in accordance with the embodiment of FIG. 1 and for use in the 1900 megahertz frequency range, the cavities are about 2 inches by 2 inches in plan view, and about 1.5 inches in depth. The resonators are about 1.2 inches in diameter, and about 0.4 inch in height. The window, as viewed in FIG. 2, is about 0.35 inch in width in its lower region, and about ¾ inch in width in its upper region. The partition thickness is about ⅛ inch. The gap G is about 0.1 inch in height. The resonators are positioned substantially equidistantly from the top and bottom of the cavity and the tuning strip, which is about 1/16 inch thick, substantially bisects the resonators. The vertical offset between the shoulders 109 and 110 is about 0.1 inch. The diameter of the tuning screw 130 is about ⅛ inch.

The filter of the present invention is not only easy to tune as compared to prior art filters, but provides a wide coupling tuning range. Thus, it is suitable both for wide passband and narrow passband filter applications. By properly choosing the window wall thickness and the strip width and coupling screw size, filters of the present invention will be able to handle high peak power filter applications.

Figure 3:
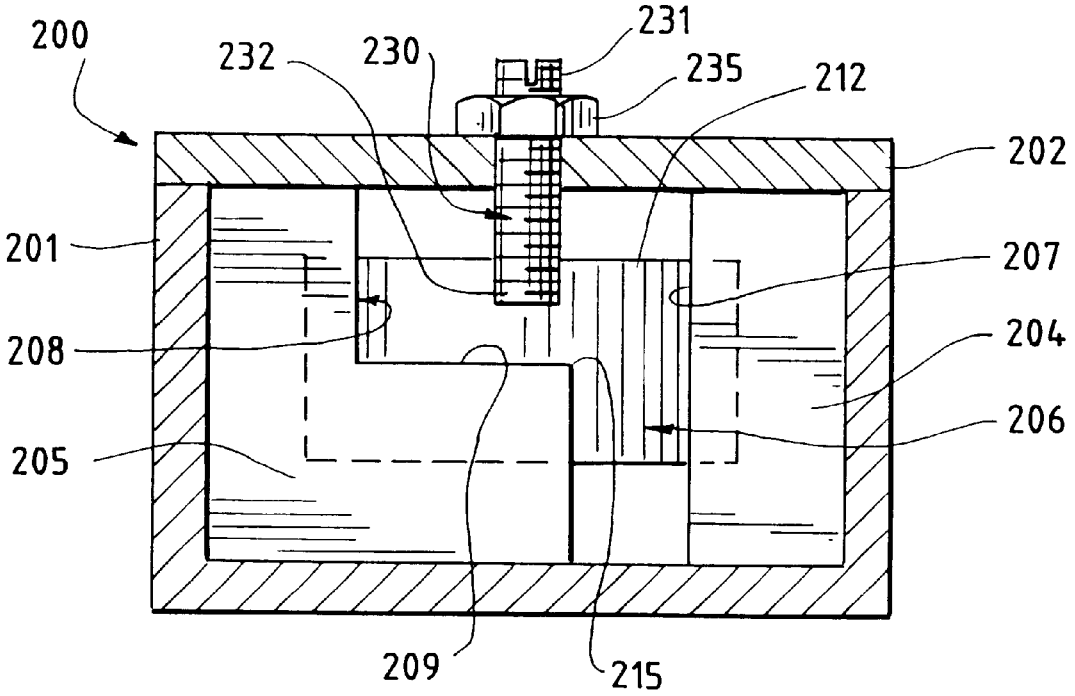
FIG. 3 is a sectional view like FIG. 2, but of a further embodiment of the present invention.

For use in narrow passband filter applications, the form of the invention of the embodiment of FIG. 3 has been found to be especially advantageous. As shown by FIG. 3, the filter 200 comprises a housing 201 and cover 202 which may be essentially the same as the housing 101 and 102. Similarly, they are connected by screws (not shown). Adjacent cavities 204 (like cavities 104) are formed as part of the housing 201. An essentially cylindrical resonator 212 is disposed in each cavity 204 and may be mounted in the manner described in connection with the embodiment of FIG. 1. Like the embodiment of FIG. 1, the housing 201 is provided with a transverse partition 205 which may be integrally formed during the manufacture of the housing. Partition 205 defines an iris or coupling window 206.

In the embodiment of FIG. 3, sidewalls 207 and 208 are provided. Sidewall 208 defines an elongated shoulder 209. Sidewall 207 and the confronting portions of sidewall 208 are generally parallel and extend perpendicularly to the base of the housing and the cover. Shoulder 209 lies generally intermediate the length of sidewall 208 and terminates inwardly at an edge 215 from which the lower section of sidewall 208 projects downwardly. The segment of window 206 below edge 215 is relatively narrow as viewed in FIG. 3.

Elongated shoulder 209 causes the electric fields of the resonators to change directions. At the zone of the shoulder edge area, more vertical electric fields are generated to meet the boundary conditions.

To adjust the tuning of the filter, a cylindrical threaded conductive tuning screw 230, as of brass, is mounted for rotation in the cover 202 of the filter. It is disposed generally in the plane of the window 206. It may be rotated from outside of the filter via its tool engaging outer end 231 to move the inner end 232 toward and away from the shoulder 209. Because of the positioning of the screw relative to the window 206 and the resonators, movement of the tuning screw will change the coupling between the resonators and the tuning of the filter. Testing has shown that the ratio of the width of the upper window segment and the width of the lower window segment (as viewed in FIG. 3) must equal 2.0 to 1 or more. Less than this ratio will degrade the tuning efficiency. Furthermore, it has been determined that the coupling screw width projection (as viewed in FIG. 3) must extend laterally close to the edge 215 to provide the greatest tuning efficiency.

Once tuned, the tuning screw may be locked in position by a lock nut 235, in the same manner described relative to the embodiment of FIG. 1.

In an exemplary filter in accordance with the embodiment of FIG. 3, a filter used in the 1900 megahertz frequency range, the dimensions of the cavities are about 2.5 inches by 2.5 inches in plan view, and 2.4 inches in height. The resonators are about 1.5 inch in diameter, and about 0.6 inch in height. The window, as viewed in FIG. 3, is about ¼ inch in width in its lower region, and about 1 inch in width in its upper region. The partition thickness is about ¼ inch. The diameter of the tuning screw is about ¼ inch, and its vertical projection is spaced about 1/16 inch in from the edge 215 of shoulder 209.

There have been described herein improved dielectric resonator loaded cavity filters. It will be apparent to those skilled in the art that modifications may be made without departing from the spirit and scope of the invention. Accordingly, it is not intended that the present invention be limited except as may be necessary in view of the appended claims.

What is claimed is:

1. An dielectric loaded cavity filter comprising:

a housing and a cover defining a housing exterior and a housing interior;

said housing interior having at least two adjacent cavities with respective dielectric resonators located therein;

said adjacent cavities being separated by a transverse partition defining a coupling window;

said coupling window having two spaced opposing sidewalls confronting each other, one of said sidewalls having an inwardly extending shoulder terminating at an edge from which the lower section of the sidewall projects downwardly, with a window portion below the shoulder and a window portion above the shoulder, the ratio of said window portion above the shoulder to said window portion below the shoulder being at least 2.0 to 1; and a tuning screw having an outer end accessible from said housing exterior, and an internal portion with an internal end extending generally planar with said window, overlying said shoulder and lying adjacent to said edge;

whereby when said tuning screw is rotated relative to said housing, said internal end of said screw moves toward or away from said shoulder.

2. The dielectric loaded cavity filter of claim 1 in which the width projection of said tuning screw extends laterally close to said edge.

3. The dielectric loaded cavity filter of claim 1 in which said tuning screw includes a lock nut.

4. The dielectric loaded cavity filter of claim 1 in which said cavities are each about 2.5×2.5 inches in plan view, and about 2.4 inches in height.

5. The dielectric loaded cavity filter of claim 1 in which the resonators are mounted to said cover and said tuning screw is secured to the base of the housing.

6. The dielectric loaded cavity filter of claim 1 in which the outer end of the tuning screw includes a tool engaging portion.

7. The dielectric loaded cavity filter of claim 1 in which said shoulder lies generally intermediate the length of said first sidewall.

8. The dielectric loaded cavity filter of claim 1 in which said dielectric resonators are essentially cylindrical.

9. The dielectric loaded cavity filter of claim 1 in which said tuning screw is mounted for rotation to said housing.

10. The dielectric loaded cavity filter of claim 1 in which said tuning screw is mounted for rotation to said cover.

11. The dielectric loaded cavity filter of claim 1 in which said tuning screw is mounted for rotation about an axis perpendicular to said cover.

12. The dielectric loaded cavity filter of claim 1 in which said cavities and transverse partition are integrally formed.

13. The dielectric loaded cavity filter of claim 1 in which said tuning screw is made of brass.

14. The dielectric loaded cavity filter of claim 13 in which said resonators are cylindrical and about 1.5 inches in diameter, and are about 0.6 inch in height.

15. The dielectric loaded cavity filter of claim 14 in which said window portion below said shoulder is about 0.25 inch in width, and about 1 inch in width in said window portion above said shoulder.

16. The dielectric loaded cavity filter of claim 15 in which said partition is about 0.25 inch thick.

17. The dielectric loaded cavity filter of claim 16 in which the diameter of said tuning screw is about 0.25 inch in its vertical projection and is spaced about 0.0625 inch from said edge of said second shoulder.

18. An dielectric loaded cavity filter comprising:

a housing and a cover defining a housing exterior and a housing interior;

said housing interior having at least two adjacent cavities with respective essentially cylindrical dielectric resonators located therein;

said adjacent cavities being separated by a transverse partition defining a coupling window;

said coupling window having two spaced opposing sidewalls confronting each other, one of said sidewalls having an inwardly extending shoulder terminating at an edge from which the lower section of the sidewall projects downwardly, with a window portion below the shoulder and a window portion above the shoulder, the ratio of said window portion above the shoulder to said window portion below the shoulder being at least 2.0 to 1; and a tuning screw mounted for rotation to said housing having an outer end accessible from said housing exterior, and an internal portion with an internal end extending generally planar with said window, overlying said shoulder and lying adjacent to said edge;

whereby when said tuning screw is rotated relative to said housing, said internal end of said screw moves toward or away from said shoulder.

19. The dielectric loaded cavity filter of claim 18 in which said cavities are each about 2.5×2.5 inches in plan view, and about 2.4 inches in height.

20. The dielectric loaded cavity filter of claim 18 in which said resonators are cylindrical and about 1.5 inches in diameter, and are about 0.6 inch in height.

* * * * *